US005601407A

United States Patent [19]

Humhauser

[11] Patent Number: 5,601,407

[45] Date of Patent: Feb. 11, 1997

[54] STATOR FOR TURBOMACHINES

[75] Inventor: Werner Humhauser, Moosburg, Germany

[73] Assignee: MTU Motoren- und Turbinen- Union Muenchen GmbH, Munich, Germany

[21] Appl. No.: 609,557

[22] Filed: Mar. 1, 1996

[30] Foreign Application Priority Data

Mar. 6, 1995 [DE] Germany ..... 195 07 673.7

[51] Int. Cl.[6] ..... F04D 29/44

[52] U.S. Cl. ..... 415/209.2; 415/209.3

[58] Field of Search ..... 415/209.2, 209.3, 415/173.7; 416/220 R, 222

[56] References Cited

U.S. PATENT DOCUMENTS

| | | | |
|---|---|---|---|
| 3,172,641 | 3/1965 | John et al. | 415/209.3 |
| 3,519,366 | 7/1970 | Campball | 415/209.3 |
| 4,820,119 | 4/1989 | Joyce . | |
| 5,129,786 | 7/1992 | Gustafson | 416/220 R |
| 5,462,403 | 10/1995 | Pannone | 415/209.2 |

FOREIGN PATENT DOCUMENTS

| | | | |
|---|---|---|---|
| 1109310 | 6/1961 | Germany . | |
| 980656 | 1/1965 | United Kingdom | 416/220 R |
| 2110768 | 6/1983 | United Kingdom . | |

*Primary Examiner*—John T. Kwon
*Attorney, Agent, or Firm*—W. G. Fasse; W. F. Fasse

[57] ABSTRACT

A stator construction for turbomachines includes a plurality of support segments (3) and a plurality of guide vane segment roots (2) forming an inner shroud, with an abradable seal liner (4) provided on the radially inner surface of the support segments. An interlocking connection is provided between the vane segment roots and the support segments. The vane segment roots and support segments interlock with one another via radially extending annular flanges (21, 31), and annular grooves (23, 33) provided in the side faces (22, 32) of the annular flanges mate with one another to form annular channels therebetween. To secure the interlocked connection, an annular securing wire (5) is inserted into the annular channels. Spring members (6) may be arranged in annular spaces between the support segments and the vane segment roots.

20 Claims, 2 Drawing Sheets

STATOR FOR TURBOMACHINES

FIELD OF THE INVENTION

The invention relates to a stator for turbomachines having a plurality of individual vanes which, individually or combined into groups, form respective vane segment roots, which are separably connected to support segments for a sealing liner at the area of the inner arc of the vane segment roots. The plurality of vane segment roots and the connected support segments, in their entirety, form what is generally known as an inner shroud.

BACKGROUND INFORMATION

In such a turbomachine, the sealing liners held by the support segments cooperate with rotating parts of the turbomachine, especially with sealing fins formed on the rotor, to form seals separating spaces of disparate pressure within the turbomachine from each other. The sealing liners are normally embodied as so-called abradable liners, which are subject to wear and therefore should be easily exchangeable. It has been recognized that problems are caused by the connection of the support segments to the sealing liners on the one hand and to the vane segment roots on the other hand, due to the given rim constraints. For example, the connections may compromise the gas-tight seal, allow vibration or chatter, or inadequately compensate for thermal expansion of the components.

According to the state of the art, it is known to form the connection of the support segments as a soldered or brazed connection. However, a disadvantage of such connections is that the vanes are subjected to a heat treatment when the sealing liners are exchanged, which may have adverse effects on the properties of the vane material. Another state of the art technique for connecting the support segments is the so-called hook connection or hook-type link, which uses radially overlapping annular grooves between the support segments on the one hand and the vane segment roots on the other hand. A disadvantage of such a connection structure is its relatively heavy weight, among other things. Another state of the art solution provides a riveted connection between the support segments and the vane segment roots, which has a disadvantage of requiring a relatively great amount of assembly work and effort for initially assembling and later exchanging the components, and also requiring a great amount of space.

SUMMARY OF THE INVENTION

In view of the above it is an object of the invention to provide a stator of the above described general type in which the connection between the vane segment roots and the support segments is achieved with minimum complexity and constructional effort, a minimum structural weight and only a modest space requirement. It is a further object of the invention that the just described connection can be separated easily and quickly without negatively affecting the individual vanes. The invention further aims to allow the use of vane segment roots and support segments having different arc lengths as desired, whereby the pitch between vane segment roots can be independent of the pitch between support segments. The invention still further aims to provide a selectably adjustable fit allowance to compensate for heat expansion of the components, especially while providing spring members to damp vibrations and chatter.

The above objects and others are achieved in a stator construction according to the invention, wherein the vane root segments and the support segments respectively include annular flanges, which are intermeshed or engaged with one another by means of mutually fitted annular end faces. This interlocking connection of the vane root segments and the support segments is secured as follows. A respective annular groove is provided in the fitted mating surfaces of each one of the components, with each pair of respective opposite grooves aligning or mating to form an annular channel, wherein the cross-sectional profile of one annular groove complements that of the opposite annular groove of the other component to form a total or complete cross-sectional profile of the annular channel. A securing wire having a cross-sectional shape adapted to the total or complete cross-sectional profile of the annular channel is inserted into the channel to secure the interlocked connection of the vane root segments with the support segments.

The inventive arrangement of the connection between the vane root segments and the support segments achieves all of the above described objects, and especially also has the advantage that the angularly measured arc lengths of the vane segment roots and the support segments are completely adjustable or adaptable. In other words, vane segment roots and support segments having different arc lengths can be used, as desired. In this context, the arc lengths may be short, for example an individual segment root may be provided for each individual vane, or the arc length may maximally extend over a semi-circular arc. The pitch of the vane segment roots can be selected entirely independently of the pitch of the support segments, so that the support segments may have shorter or longer arc lengths than the vane segment roots. Furthermore, the joints between adjacent vane segment roots may or may not be radially aligned with the joints between adjacent support segments as desired. The only further adjustment or adaptation needed to be made is to adapt the length of the respective securing wires to the corresponding arc length of the vane segment roots or support segments that are being used.

In an advantageous aspect of the present invention, the securing wire has a circular cross-section so that commercially available wires can be used. However, the circular cross-section is not absolutely necessary, but instead the securing wire may have other cross-sectional shapes, such as oval, elliptical, rectangular or other polygonal shapes. However, for a proper and trouble-free securing function, it is desirable that the annular grooves form square or at least approximately square shoulders toward the mating surfaces. In this manner an undesirable binding or jamming of the components can be prevented.

In a further advantageous aspect of the present invention, in order to prevent the securing wire from shifting in the circumferential direction, at least one end of the wire is bent and abuts or lies against a suitably adapted stop surface of one of the annular flanges. In this context, the end of the wire can be bent in either a radial plane or an axial direction. Normally, the wire end will be bent at a right angle, although bending angles other than 90° are also possible.

In a preferred aspect of the present invention, the width of the annular grooves is slightly greater than the mean radial extension, e.g. the diameter, of the securing wire. This arrangement allows some radial play between the interconnected components, i.e. the support segments on the one hand and the vane segment roots on the other hand, which may be advantageous in view of thermal expansion effects.

To prevent undesirable expansion movements between support segments on the one hand, and vane segment roots on the other hand, it is advantageous if the vane segment roots and the support segments form an annular space therebetween in the assembled condition. Then, spring members such as spring clips or spring clasps are inserted into the annular space in order to spring-bias or pre-tension the two components, namely the vane segment roots and the support segments, against one another.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
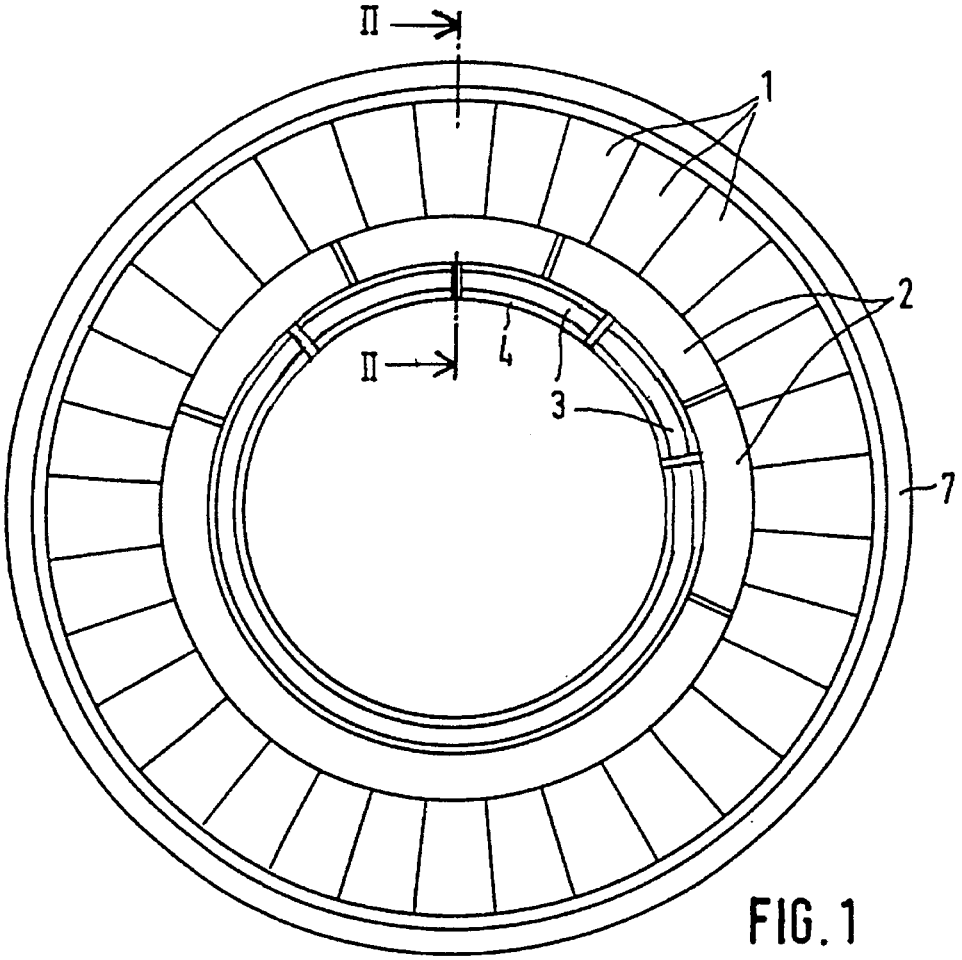
FIG. 1 is a schematic axial view of a turbomachine stator, viewed along line I—I of FIG. 2.

The schematic axial view of a turbomachine stator as shown in FIG. 1 includes an outer shroud 7, a plurality of individual guide vanes 1, and an inner shroud consisting of vane segment roots 2 and support segments 3 connected to the vane segment roots 2. The outer shroud 7 of the stator may be a one-piece ring, which must have an opening or other provision for threading in the guide vanes 1 at one point along its circumference, or may be multiply divided so that it consists of several segments, as does the inner shroud. The vane segment roots 2 illustrated in the example embodiment according to FIG. 1 each respectively carry four individual vanes 1. However, the vane segment roots 2 may alternatively have any other desired arc length, for example a short vane segment root for one guide vane 1, or a long vane segment root extending over an arc of up to 180°.

Figure 2:
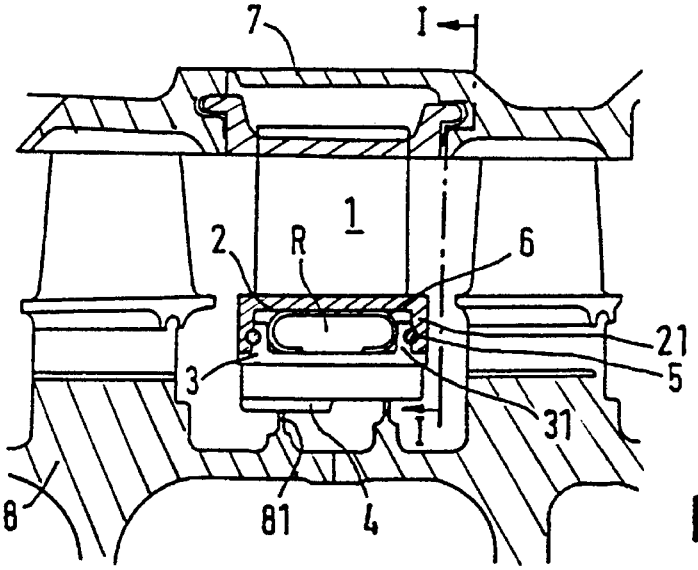
FIG. 2 is a partial sectional view of the stator of FIG. 1 taken along line II—II of FIG. 1.

The support segments 3 having a sealing liner 4 on their inner circumference are connected to the vane segment roots 2 in the area of the respective inner arcs of the vane segment roots. When the turbomachine is in its assembled state, the sealing liner 4 cooperates with sealing edges 81 of a rotor 8 to form a seal, as shown in FIG. 2. In the illustrated example embodiment, the support segments 3 extend over a different arc length than the vane segment roots 2, and the parting lines or joints between adjacent support segments 3 are offset relative to those of the vane segment roots 2. However, it is also possible according to the invention that the support segments and vane segment roots have equal arc lengths, with aligned or non-aligned parting lines. Generally, it should be understood that the inventive technique described below for connecting the vane segment roots 2 with the support segments 3 allows support segments and vane segment roots having any selected equal or different arc lengths to be used. Thus, it is possible, for example, that two or more support segments are provided per vane segment root, or vice versa.

Figure 3:
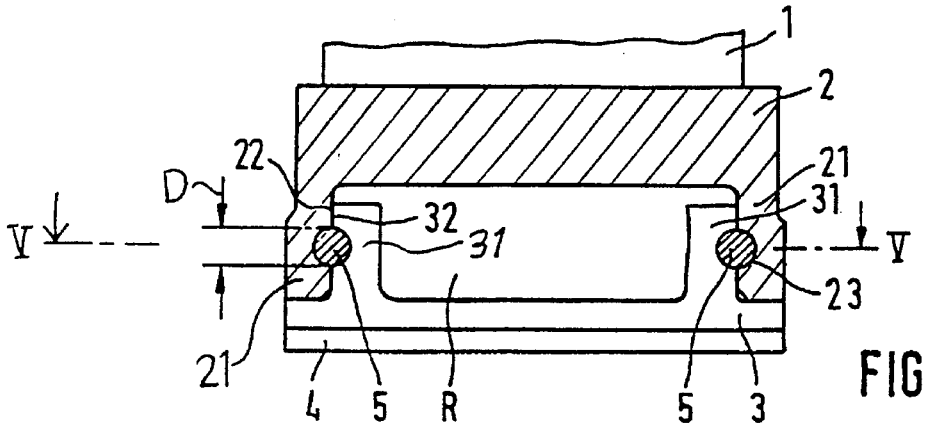
FIG. 3 is an enlarged view of a portion of FIG. 2, showing the connection between a vane segment root and a support segment for the sealing liner.

The separable connection between the vane segment roots 2 and the support segments 3 is apparent especially from the cross-sectional views of FIGS. 2 and 3. The enlarged cross-sectional view of FIG. 3 illustrates the connection arrangement in detail. On its two sides, each vane segment root 2 comprises two respective annular flanges 21 with respective annular surfaces 22 at the axially inner side faces thereof. The support segments 3 comprise annular flanges 31, with annular surfaces 32 at their axially outer side faces. The annular surfaces 22 and 32, of the vane segment roots and of the support segments, respectively, are fitted or adapted to one another, so that the components can be engaged or interlocked, one in the other, as shown in FIGS. 2 and 3. In other words, the axially outer surfaces 32 of the annular flanges 31 of the support segment 3 are preferably arranged to fit closely between the axially inner surfaces 22 of the annular flanges 21 of the vane segment root 2.

Figure 4:
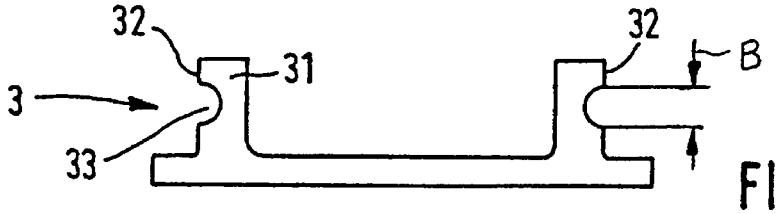
FIG. 4 is a sectional view of a support segment according to FIG. 3, by itself, without a sealing liner.

To secure the interlocking connection of the two components, the mating surfaces, i.e. the annular surfaces 22 and 32, of the two components, each comprise an annular groove 23, 33, as shown especially in FIGS. 3 and 4. In the assembled condition, the cross-sectional profile of each of the grooves 23 or 33 complements the cross-sectional profile of the opposite mating annular groove 33 or 23 of the other component to form an annular channel having a total or complete cross-sectional profile. In the illustrated example embodiment, each of the annular grooves has an approximately semicircular cross-section, so that the two opposite mating annular grooves combine to form an annular channel with a full-circle cross-section. In order to secure or lock together the interlocked connection, a securing wire 5 is inserted into the circular cross-sectioned annular channel formed by each mating pair of grooves 23, 33. Preferably, the wire 5 is inserted into the annular space after the two components have been engaged or interlocked, one in the other. However, it is alternatively possible first to insert the securing wire 5 into the annular groove of one of the two components, and then to circumferentially engage the other component with or in the first component.

FIG. 4 shows the support segment 3, isolated by itself, according to the enlarged view of FIG. 3. The width B of the annular groove 33 is preferably slightly larger than the radial dimension or extension D of the securing wire 5 (see FIG. 3). It should be understood, that for a circular cross-sectional securing wire 5, the radial extension D refers to the diameter of the wire. The width of the complementary groove 23 of the vane segment root 2 can also be slightly larger than the radial extension of the securing wire 5. For example, the groove width should preferably be in the range from about 8% to about 12% greater than the mean radial dimension of the securing wire. This wider dimensioning of the grooves allows a slight amount of play in the radial direction between the support segment and the vane segment root. Such play allows thermal expansion of the components to be compensated for, while maintaining a good gas seal. The wire 5 is preferably made of spring steel, but can comprise other materials to provide strength, thermal expansion, and sealing properties as desired.

In order to prevent undesired movement, such as chattering, or vibration between the vane root segment 2 and the support segment 3, a spring member, such as a spring clip or spring clasp 6, is preferably inserted in an annular space R formed between the two components, as shown in FIG. 2. The spring member 6 tensions the two components against one another, i.e. especially urges the two components apart or away from one another against the retaining force of the securing wire 5. Insofar as the spring member 6 lies broadly or surfacially against the components, it will simultaneously operate to attenuate or damp frictional vibrations.

Figure 5:
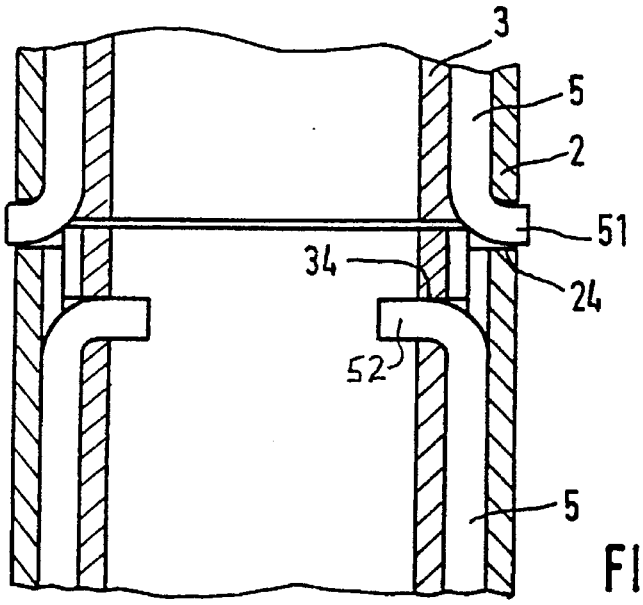
FIG. 5 is a sectional view taken along the line V—V of FIG. 3 in the area of the bent securing wire ends.

The length of the securing wire 5 can be variably selected as need or desired, and does not have to correspond to the arc length of a support segment or a vane segment root. To prevent the securing wire 5 from drifting or creeping circumferentially, at least one wire end 51 is bent, and abuts or lies against a suitably adapted stop surface 24 of the vane segment root 2, as shown in FIG. 5. The example embodiment according to FIG. 5 shows a second securing wire 5 with an end 52 that is bent in the opposite direction, i.e. opposite the direction of the wire end 51. The wire end 52 abuts against a stop surface 34 provided on the support segment 3. This arrangement of securing wires is merely intended to show that the respective ends of the securing wires can be bent in various ways and various directions in order to secure the wire against moving in the circumferential direction. Thus, for example, it is also possible to bend the ends of the securing wires in a radially outward or radially inward direction, although such an arrangement is not shown in the drawings.

Although the invention has been described with reference to specific example embodiments, it will be appreciated that it is intended to cover all modifications and equivalents within the scope of the appended claims. For example, the invention is not limited to vane segment roots and support segments having two annular flanges each. Instead, the invention also encompasses an arrangement of one flange of a first component received between two flanges of the other component, or three or four flanges of a first component engaging with two, three or four flanges of a second component, or other numbers and combinations of engaging flanges.

What is claimed is:

1. A stator assembly for a turbomachine, comprising a plurality of individual vanes, a plurality of vane segment roots with at least one of said vanes extending from each of said roots, a plurality of support segments arranged at a radially inner curved side of said vane segment roots, a sealing liner arranged on said support segments, and a securing wire separably securing said support segments to said vane segment roots, wherein each said vane segment root comprises at least one annular first flange having an annular first mating surface with an annular first groove therein, each said support segment comprises at least one annular second flange having an annular second mating surface with an annular second groove therein, said first and second flanges engage one another with said first and second mating surfaces overlapping each other and said annular first and second grooves complementing each other to form therebetween an annular channel having a channel cross-sectional profile, and said securing wire is arranged in said annular channel to effect said separable securing of said support segments to said vane segment roots.

2. The stator assembly of claim 1, wherein a plurality of said vanes extend from each one of said vane segment roots.

3. The stator assembly of claim 1, wherein each said vane segment root comprises a plurality of said annular first flanges, which each have at least one said annular first mating surface.

4. The stator assembly of claim 3, wherein each said vane segment root has exactly two of said annular first flanges.

5. The stator assembly of claim 4, wherein each said support segment has exactly two of said annular second flanges.

6. The stator assembly of claim 5, wherein said annular first mating surfaces are axially inwardly facing surfaces, said annular second mating surfaces are axially outwardly facing surfaces, and said two annular second flanges are received between said two annular first flanges.

7. The stator assembly of claim 6, wherein at least one of said flanges has a stop surface adjoining said annular groove thereof, and said securing wire comprises a bent end portion arranged to lie against said stop surface and fix said securing wire against movement in a circumferential direction.

8. The stator assembly of claim 3, wherein each said support segment comprises a plurality of said annular second flanges, which each have at least one said annular second mating surface.

9. The stator assembly of claim 6, wherein an annular space is formed between said two annular second flanges, and said stator assembly further comprises a spring member arranged in said annular space to spring-bias said vane segment root relative to said support segment.

10. The stator assembly of claim 9, wherein said securing wire has a cross-sectional profile with a mean radial width, and at least one of said first and second grooves has a groove width that is larger than said mean radial width of said securing wire to allow play between said vane segment roots and said support segments.

11. The stator assembly of claim 9, wherein each said vane segment root has a first arc length, and each said support segment has a second arc length that is different from said first arc length.

12. The stator assembly of claim 1, wherein said securing wire has a wire cross-sectional profile adapted to said channel cross-sectional profile, and said wire cross-sectional profile is substantially circular.

13. The stator assembly of claim 1, wherein at least one of said flanges has a stop surface adjoining said annular groove thereof, and said securing wire comprises a bent end portion arranged to lie against said stop surface and fix said securing wire against movement in a circumferential direction.

14. The stator assembly of claim 13, wherein said stop surface and said bent end portion of said wire extend substantially in an axial direction of said turbomachine.

15. The stator assembly of claim 1, wherein said securing wire has a cross-sectional profile with a mean radial width, and at least one of said first and second grooves has a groove width that is larger than said mean radial width of said securing wire to allow play between said vane segment roots and said support segments.

16. The stator assembly of claim 1, wherein said securing wire consists of spring steel.

17. The stator assembly of claim 1, wherein each said vane segment root has a first arc length, and each said support segment has a second arc length that is different from said first arc length.

18. The stator assembly of claim 1, wherein joints between adjacent ones of said vane segment roots are not aligned with joints between adjacent ones of said support segments.

19. The stator assembly of claim 1, wherein each said vane segment root comprises a plurality of said first flanges, each said support segment comprises a plurality of said second flanges, an annular space is formed between at least two of said flanges, and said stator assembly further comprises a plurality of spring members arranged in said annular space to spring-bias said vane segment roots relative to said support segments.

20. The stator assembly of claim 1, wherein said securing wire has a cross-sectional profile adapted to said channel cross-sectional profile.

* * * * *